United States Patent [19]

Johnson et al.

[11] Patent Number: 4,667,874

[45] Date of Patent: May 26, 1987

[54] ENERGY SAVING FURNACE CONTROLLER

[75] Inventors: Harold R. Johnson, 141 S. Skyline Dr., Mankato, Minn. 56001; Steven E. Lombardi, New Brighton, Minn.

[73] Assignee: Harold R. Johnson, Mankato, Minn.

[21] Appl. No.: 758,147

[22] Filed: Jul. 23, 1985

[51] Int. Cl.[4] ..... F23N 5/20

[52] U.S. Cl. ..... 236/10; 236/46 E

[58] Field of Search ..... 236/10, 11, 46 E; 165/12; 364/557, 505

[56] References Cited

U.S. PATENT DOCUMENTS

| | | | |
|---|---|---|---|
| 2,158,250 | 5/1939 | Peters | 236/10 |
| 2,862,666 | 12/1958 | Kriechbaum | 236/11 |
| 4,136,730 | 1/1979 | Kinsey | 62/231 X |
| 4,319,713 | 3/1982 | Baker | 236/11 |
| 4,356,962 | 11/1982 | Levine | 236/11 |
| 4,423,765 | 1/1984 | Hildebrand | 236/46 R |
| 4,453,590 | 6/1984 | Holliday et al. | 236/46 R |
| 4,485,966 | 12/1984 | Cartmell et al. | 236/46 R |
| 4,487,361 | 12/1984 | Brown | 236/11 |
| 4,552,304 | 11/1985 | Papazian | 236/46 F |

OTHER PUBLICATIONS

Exhibit "A"—ad disclosing a temperature sensing device.
Exhibit "B"—photocopied report describing a product by Stentor Engineering Co.
Exhibit "C"—brochure disclosing energy saving device.
Exhibit "D"—brochure disclosing duty cycler.
Exhibit "E"—brochure disclosing energy saving device called Enerpro.
Exhibit "F"—ad announcing the Monarch 631.
Exhibit "G"—brochure disclosing product called SavIt.
Exhibit "H"—newspaper clipping regarding duty cyclers.
Exhibit "I"—brochure disclosing product sold by General Filters, Inc.
Exhibit "J"—brochure disclosing Technical Energy Control (TEC).
Sensor Saver TM, advertisement/installation instructions.
The Resident-ECP, advertisement.
Thermo-Pulse TM, advertisement.
Energymatic 200, advertisement.

*Primary Examiner*—William E. Wayner
*Attorney, Agent, or Firm*—Merchant, Gould, Smith Edell, Welter & Schmidt

[57] ABSTRACT

An auxiliary heating/cooling system controller is connected in series between the household thermostat and the furnace burner valve and compressor. The controller includes a timing control which is responsive to a preset time interval valve and the plenum temperature to cycle the furnace burner on and off in order to moderate the temperature of the furnace heat exchanger, thus improving furnace efficiency. Upon installation the controller is programmed with a digital valve corresponding to the delay between a call for heat from the household thermostat and the initiation of the furnace fan. This value is then used to set a timer in the controller which synchronizes the initiation of the duty cycle control of the burner to the start of the fan at the beginning of a heating cycle, and to control the cycle time of the burner. A plenum thermostat monitors the temperature of the air produced by the furnace and if the air exceeds a predetermined limit the OFF time of the burner is increased. The cooling system control provides for cycling the compressor on and off in accordance with a programmed digital valve. The fan is kept activated to circulate dry, cool air when the compressor is in the off time of its cycle.

12 Claims, 3 Drawing Figures

| S4 | S3 | S2 | S1 | Off Time | On Time | Off Time As A % Of Total Time |
|---|---|---|---|---|---|---|
| ON | ON | ON | ON | 5m | 8m | 40% |
| ON | ON | ON | OFF | 5m | 12m | 30% |
| ON | ON | OFF | ON | 5m | 20m | 20% |
| ON | ON | OFF | OFF | 5m | 40m | 10% |
| ON | OFF | ON | ON | 10m | 15m | 40% |
| ON | OFF | ON | OFF | 10m | 24m | 30% |
| ON | OFF | OFF | ON | 10m | 40m | 20% |
| ON | OFF | OFF | OFF | 10m | 90m | 10% |
| OFF | ON | ON | ON | 15m | 23m | 40% |
| OFF | ON | ON | OFF | 15m | 35m | 30% |
| OFF | ON | OFF | ON | 15m | 60m | 20% |
| OFF | ON | OFF | OFF | 15m | 135m | 10% |
| OFF | OFF | ON | ON | 20m | 30m | 40% |
| OFF | OFF | ON | OFF | 20m | 47m | 30% |
| OFF | OFF | OFF | ON | 20m | 80m | 20% |
| OFF | OFF | OFF | OFF | 20m | 180m | 10% |

FIG. 3

FIG. 2

| Time from Thermostat On Until Fan Starts | Switch Setting | | | | Amount Off Time Burner Is Disabled | |
|---|---|---|---|---|---|---|
| | 1 | 2 | 3 | 4 | Plenum Less Than 110° F | Plenum Greater Than 110° F |
| 0–20 secs | OFF | OFF | OFF | OFF | 4 secs. | 8 secs |
| 20–40 | OFF | OFF | OFF | ON | 8 | 16 |
| 40–60 | OFF | OFF | ON | OFF | 12 | 24 |
| 60–80 | OFF | OFF | ON | ON | 16 | 32 |
| 80–120 | OFF | ON | OFF | OFF | 24 | 48 |
| 120–180 | OFF | ON | OFF | ON | 36 | 72 |
| 180–240 | OFF | ON | ON | OFF | 48 | 96 |
| 240–300 | OFF | ON | ON | ON | 60 | 120 |
| 300–360 | ON | OFF | OFF | OFF | 72 | 144 |
| 360–420 | ON | OFF | OFF | ON | 84 | 168 |
| 420–480 | ON | OFF | ON | OFF | 96 | 192 |
| 480–540 | ON | OFF | ON | ON | 108 | 216 |
| 540–600 | ON | ON | OFF | OFF | 120 | 240 |
| 600–660 | ON | ON | OFF | ON | 132 | 264 |
| 660–720 | ON | ON | ON | OFF | 144 | 288 |
| 720–780 | ON | ON | ON | ON | 156 | 312 |

ENERGY SAVING FURNACE CONTROLLER

TECHNICAL FIELD OF THE INVENTION

The present invention relates to heating/air conditioning control, and more particularly to a circuit for improving the efficiency of forced air systems.

BACKGROUND OF THE INVENTION

It is a principle of thermodynamics that the greater the difference in temperature at an interface the higher the efficiency of heat transfer through the interface. This principle, as applied to forced air heating systems, indicates that the heat exchanger should be operated at as low a temperature as will allow sufficient hot air to be produced.

Many forced air heating systems, particularly older ones, operate the heat exchanger at an undesireable excessively high temperature. The result is a loss of furnace efficiency, or from another point of view an unnecessary waste of energy up the flue. In addition, an excessively hot exchanger produces excessively hot heating air which most often results in household temperature overshoot, and consequently undersireably large swings in ambient air temperature.

As summarized and described in detail below, the present invention provides an "add-on" or auxiliary furnace controller which corrects or mitigates heat exchanger overheating. The invention may thus be installed in a heating system, particularly an older one, to improve its efficiency, and to improve household temperature stability.

SUMMARY OF THE INVENTION

The present invention provides an auxiliary controller for installation in a forced air heating system of the type including a furnace controlled by a household thermostat, with the furnace including a burner valve, heat exchanger, plenum and fan. According to one aspect of the invention there is provided an electromechanical relay and timing circuit for controlling the relay. The relay is connectable between the household thermostat and the burner valve, such that the heating system operates normally or as if the controller of the present invention was not installed provided that the relay is closed. The timing means controls the duty cycle of the burner valve by opening and closing the relay. The timing means includes means for timing alternating first and second intervals, the first interval at least substantially equal to the length of time that the furnace normally delays between a call for heat from the household thermostat and the start of the furnace fan, with the second interval corresponding to a predetermined percentage of the first interval. The relay is kept closed during the first interval and is opened during the second interval whereby the burner valve is cycled open and shut, and the furnace burner is cycled on and off. The timing means further includes means for synchronizing it to start timing at the beginning of the first interval in response to a call for heat from the household thermostat. This assures that the furnace heat exchanger gets hot enough to rid itself of condensation from combustion, and to ensure that the furnace fan is triggered to run as soon after the beginning of a heat cycle as possible.

According to another aspect of the invention the controller further includes a plenum thermostat mountable in the furnace plenum, and the timing means includes means responsive to the plenum thermostat to increase the second time interval by a predetermined amount in response to a plenum temperature in excess of a desired level. Accordingly, the controller of the present invention may adapt its cycling of the furnace burner according to actual conditions in the furnace.

BRIEF DESCRIPTION OF THE DRAWING

FIG. 2 is a table showing, among other things, burner OFF time as a function of system start-up delay and plenum temperature; and FIG. 3 is a table showing selectable compressor cycle times.

DETAILED DESCRIPTION OF THE INVENTION

Figure 1:
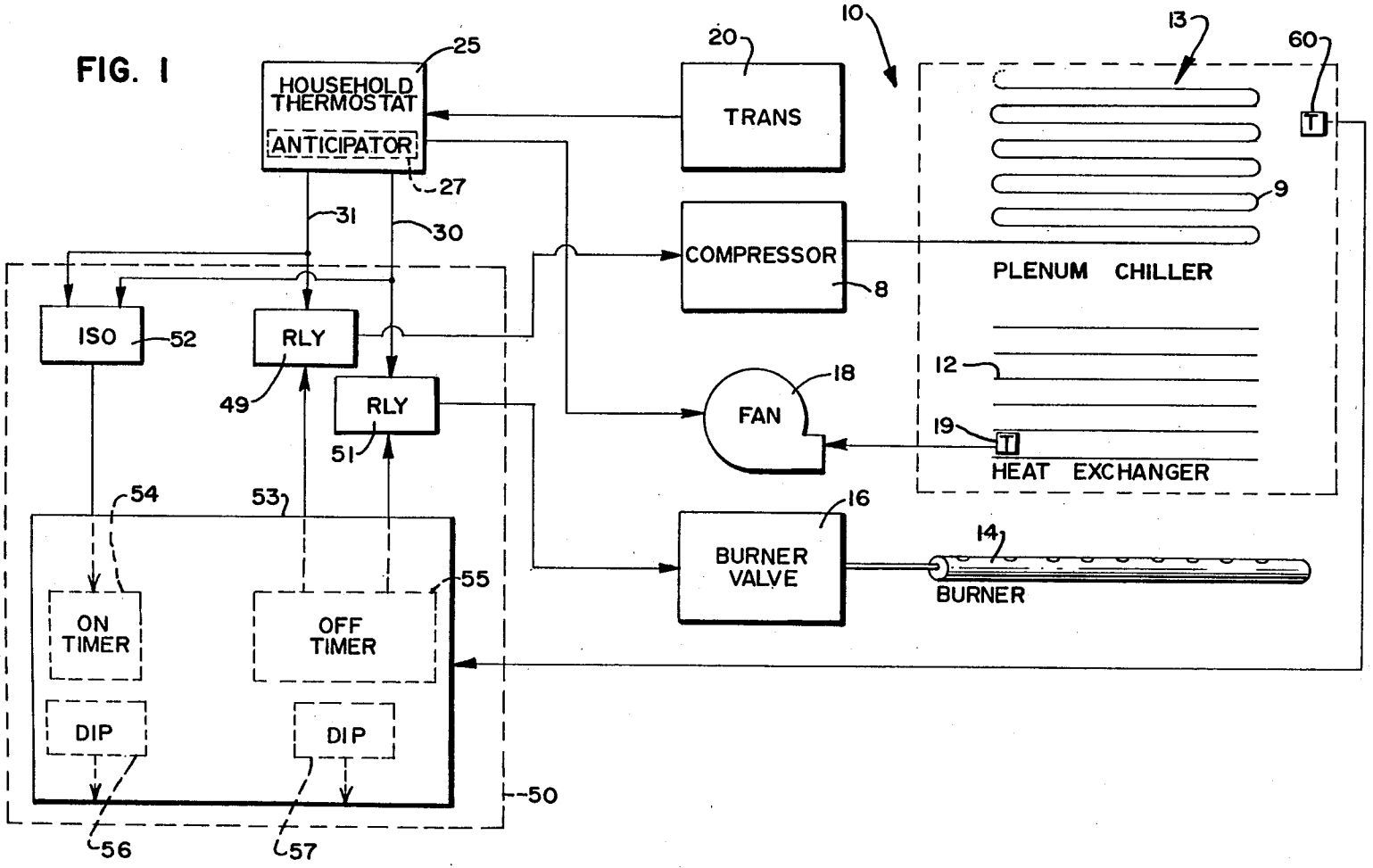
FIG. 1 is a simplified schematic block diagram of a heating/cooling system including a present invention installed therein.

Referring to FIG. 1 there is shown a simplified schematic block diagram of the present invention as implemented in a typical household heating/cooling system. The heating portion of the system includes a furnace, generally designated with numeral 10, which includes a heat exchanger 12, a burner 14 located underneath it, a burner valve 16, a fan 18, a fan thermostat 19 and a low voltage transformer 20. The cooling portion of the system utilizes the fan 18 and includes a chiller 9 mounted in the furnace plenum 13. Chiller 9 is connected in a conventional manner to compressor 8.

Typically, (contrary to what is shown in FIG. 1) the household thermostat 25 interfaces directly with transformer 20 and burner valve 16 in order to turn valve 16 on and off in a conventional manner according to the setting of the thermostat. Thermostat 25 would typically include a heat anticipator 27, which is employed to compensate for the effects of temperature overshoot. To operate the cooling portion of the system, thermostat 25 typically interfaces directly with the compressor 8 and fan 18 to turn them on and off in a conventional manner according, again, to the thermostat setting.

The conventional system described above (absent the furnace controller 50 of the present invention) generally operates as follows. In a heating mode, when the household temperature falls below the set temperature, thermostat 25 calls for heat, causing voltage to be applied from transformer 20 to burner valve 16. Valve 16 is thus commanded to open and ignite burner 14, whereby burner 14 begins to apply heat to heat exchanger 12. In certain furnaces the burner valve 16 may delay up to one minute before the burner ignites after voltage is applied. For instance, intermittent pilot furnaces normally have to ignite a pilot which in turn heats a thermocouple and opens the main burner valve. This delay can be in the range of a few seconds up to one minute.

Once the burner is on, the temperature of heat exchanger 12 begins to rise. Generally, this temperature rise is slower on older furnaces as compared to newer furnaces, due for the most part to differences in heat exchanger mass. When the heat exchanger 12 is hot enough, fan thermostat 19 starts fan 18 and hot air is produced by the furnace. Once thermostat 25 is satisfied, valve 16 is closed, and burner 14 is shut off. Fan 18 continues to run under the control of thermostat 19, which keeps the fan active until most of the useful heat has been extracted from exchanger 12.

In a cooling mode, the thermostat 25 activates compressor 8 and fan 18 when the household temperature rises above the set level, thereby cooling chiller 9 and sending cool, dry air circulating throughout the household. It is noted that in the case of cooling operation the fan 18 is activated via thermostat 25 and not via exchanger thermostat 19, as in the heating mode.

The present invention provides an auxiliary controller 50 which may be installed in series between the household thermostat 25 and the burner valve 16 and compressor 18 as shown in FIG. 1. In general, controller 50 operates during an ON cycle of the heating system to periodically deactivate burner valve 16, by interrupting the application of voltage to the valve from transformer 20, in order to prevent heat exchanger 12 from overheating. In the cooling mode, controller 50 periodically deactivates the compressor, while permitting the fan to continue running, thereby saving power while keeping dry, cool air circulating throughout the house.

Controller 50 includes electromechanical relays 49 and 51, an opto-isolator sensor 52, a timing control circuit 53 including a pair of timers 54 and 55 and digital switch components 56 and 57. Also provided with controller 50 is a plenum thermostat 60, which is preferably installed by attaching it to the sheet metal housing of the furnace plenum 13.

Preferably, relays 49 and 51 have normally closed contacts, and are connected in series between thermostat 25 and the compressor 8 and burner valve 16, respectively. Thus, controller 50 is connected in a fail-safe configuration to assure that in the event of its failure the system's thermostat circuit will remain connected in its normal configuration. Opto-isolator 52 is connected to the control lines 30 and 31 of thermostat 25 and to timing control 53. In operation, the opto-isolator 52 provides a signal to timing control 53 indicative of when the thermostat 25 is calling for heating via line 30 or cooling via line 31. Timing control 53 also receives an input from switches 56 and 57, which are each preferably provided in the form of a four-switch dual-in-package switch in which each of the four switches may be set in either an on or off condition. As will be explained in more detail below, timing control 53 is responsive to switches 56 and 57 in order to set the timing intervals utilized to control relays 49 and 51 and consequently compressor 8 and burner valve 14. As will also be explained below, the timing intervals of timing control 53 are also adjusted according to input from thermostat 60 when the controller is in heating mode operation. Preferably, thermostat 60 is a bimetalic snap action thermostat, set to trip at a temperature of approximately 110° F.

When the system is heating (as sensed by opto-isolator 52), controller 50 regulates the temperature of the heat exchanger 12 by duty cylce control of the burner 14. At installation, timing control 53 is initialized or "programmed" for operation via switches 56. To determine the proper setting for switches 56, the installer manually measures the time from when the household thermostat 25 calls for heat to the time the fan 18 comes on. Preferably, this measurement is made when the furnace is cool. The installer then refers to a predetermined table from which the approved switch settings may be determined. Once set switches 56 provide the basis for synchronizing the initiation of burner cycling to the furnace ON cycle, and for the on-off cycling interval for the furnace burner.

Referring to FIG. 2, there is illustrated a table showing the breakdown of switch settings and burner ON and OFF times preferred for and used in the timing control 53 of the present invention. For instance, if the installer measures a 490 second start-up delay, the switches are set to ON-OFF-ON-ON. At start up, as sensed via opto-isolator 52, controller 50 delays a first interval of at least 540 seconds (a time at least equal to the measured delay) before turning burner 14 off for a second OFF-time interval of 108 seconds if the plenum temperature is less than approximately 110° F., and 215 seconds if above 110° F. (this may vary back and forth during a heating period). After the OFF-time interval, timing control 53 reverts to timing another first (start-up) interval during which time burner 14 is reactivated, after which the burner is again deactivated for an OFF-time interval, and so on. Thus, control 53 alternates timing intervals until the call for heat is dropped.

In operation, timing control 53 monitors the output of thermostat 25 via opto-isolator 52. When a call for heat is sensed, timing control 53 initiates timer 54, which times out an interval corresponding to that programmed via switches 56. This interval, as described above, corresponds to the measured delay between a call for heat and the time that fan 18 begins to operate. During this time controller 50 permits the heating system to operate in its normal manner, allowing heat exchanger 12 to heat up to its normal starting temperature. For instance, if the measured start-up time is 70 seconds, switches 56 would be set OFF-OFF-ON-ON. Timing control 53 would thus respond to a call for heat by thermostat 25 (as sensed via opto-isolator 52) by timing an 80 second interval, via timer 54, before cycling burner 14 off under control of timer 55. The burner is then maintained off by control 53 for a period of time corresponding to the setting of switches 57, as shown in the table illustrated in FIG. 2. Thus, controller 50 may be individually adjusted for each furnace to allow the furnace's heat exchanger to reach a temperature high enough to rid itself of condensation resulting from normal combustion, and to allow for the fastest possible activation of fan 18. Thereafter, so long as the thermostat 25 maintains its call for heat timing control 53 alternates between timing ON and OFF intervals, via timers 54 and 55, respectively, whereby the burner is cycled on and off, moderating the temperature of the heat exchange 12.

Timer 55 is also responsive to plenum thermostat 60 in order to control the OFF cycle of burner 14. More specifically, as shown in the table of FIG. 2, when thermostat 60 is activated (i.e. the temperature in the plenum is in excess of approximately 110°) timer 55 responds by doubling the amount of OFF time for the burner. Thus, the present invention is also responsive to the actual plenum temperature of the furnace to regulate heat exchanger temperature.

The sequential operation of the heating system with the controller 50 of the present invention installed may be summarized as follows:

1. The household thermostat 25 calls for heat.
2. The burner valves 16 senses the signal and starts the burner. (Some furnaces may have a delay.)
3. Once the burner 14 is on, the temperature of the heat exchanger 12 begins to rise.
4. When the heat exchanger 12 is hot enough, the fan control thermostat 19 starts the fan and hot air is produced by the furnace.

5. At the approximate time that the fan starts, controller 50 shuts off the burner valve 16 via relay 51, extinguishing the flame in burner 14.
6. The fan 18 continues to run until the heat exchanger cools to the point where the fan thermostat 19 is close to reset, but preferably before, or at least near the time the fan actually shuts off timer 55 times out and controller 50 reactivates burner 14 to bring the heat exchanger temperature back up. This cycling then continues until the household thermostat 25 is satisfied, and the call for heat is dropped.

Thus, it may be seen that during a period of fan operation the furnace produces hot air, but the burner 14 is off for a period of time which it would have otherwise been on if the controller 50 where not used. Thus, the heat exchanger 12 remains cooler than it would otherwise, thus enhancing the transfer of heat from burner 14 thereto, and thus enhancing the efficiency of the furnace. In addition, since the hot air produced by the furnace is generally "cooler", there is less overshoot and undershoot in the heating system, resulting in a more constant and pleasant ambient temperature in the household. With regard to this point, it should be noted that it is preferable that the heat anticipater 27 be disabled in the household thermostat 25. Otherwise, the thermostat 25 may drop its call for heat prematurely.

The cooling system control aspect of controller 50 is quite similar to that of the heating control. Thus, during the time thermostat 25 is calling for cooling controller 50 is cycling compressor 8 on and off according to the settings of switches 57. Referring to FIG. 3 there is shown a table setting forth the preferred ON-OFF intervals executed by controller 53 in response to the settings of switches 57. Thus, if the settings OFF-ON-ON-ON are selected, controller 53 will time a first ON-interval (beginning when a call for cooling is sensed on line 31 via opto-isolator 52) of 23 minutes, via timer 54, and then an OFF-interval of 15 minutes and so on alternating back and forth, turning compressor 8 on and off while fan 18 remains running.

While there is a substantial similarity between the cycling aspects of the control of compressor 8 and burner 14, there is a significant difference in terms of the manner in which the cooling system operation saves energy costs. Specifically, there is no improvement in system efficiency per se accomplished in cycling the compressor on and off because the chiller 9 essentially has no significant heat capacity. Rather, savings is obtained by sacrificing some cooling during compressor off-times. However, the system of the present invention keeps the fan 18 circulating the dry, cool (vs. chilled) household air around during compressor off-times. Thus is more comfortable than if the thermostat where just set up "higher", because normal thermostat operation shuts the fan off when the set threshold is met, thus allowing the cool dry air to stagnate and pool on the floors and in the lower reaches of the dwelling. Also, the desired setting of switches of 57 (and consequently OFF-ON times) is determined by experience, so that the user has the installer select one of the available ON-intervals corresponding to one of the OFF-intervals provided. The OFF-interval should be selected to correspond to the minimum amount of time to permit adequate head pressure dissipation and thus provide for safe start up. The selected ON-interval may be changed until the system operates to the user's satisfaction. The more tolerance to heat and humidity the user has, the higher the savings possible. In other words, the use selects what percentage savings desired. It should be understood that the household thermostat 25 may not be "satisfied" while the outside air temperature is above a certain level.

Preferably, controller 50 is constructed primarily of solid state components, which may be powered via the low voltage transformer 20 of the heating system. Thus, it is contemplated that the combination of relay 51 and the solid state components of the system would draw no more than 250 milliamps maximum. Thus, there is no need to deal with dangerous household currents when installing the controller which is preferably located near the furnace. It is also contemplated that controller 50 may be provided with a pair of indicator lights, one of which would indicate that power is supplied to the controller and the other of which would indicate that the controller is actively disabling the burner 14 or compressor 8. Although the controller 50 is shown in its combination heating/cooling control embodiment, it shall be understood that it may also be provided for heating control or cooling control only as desired.

Thus, as demonstrated, the present invention provides an auxiliary heating/cooling system controller which provides for improved heating system efficiency cooling operation savings. It will also be seen that the invention is simple in design, easy to install, adaptable to a range of furnace designs, and adapted for fail-safe operation.

Although the invention has been illustrated with respect to details of its structure and function, it shall be understood that changes may be made in detail in structure without departing from the spirit and scope of the invention as set forth in the claims apended hereto.

What is claimed is:

1. In a forced air heating system including a furnace controlled by a household thermostat, the furnace including a burner, burning valve, heat exchanger, plenum and fan for circulating air through the heat exchanger and plenum, an auxiliary controller comprising:

relay means connectable between the household thermostate and the furnace burner valve; and timing means for controlling the duty cycle of the furnace burner valve by opening and closing said relay, said timing means including means for timing alternating first and second intervals, said first interval at least substantially equal to the length of time the furnace delays between a call for heat from the household thermostat and the start of the furnace fan when the furnace is started from a cool state, said second interval corresponding to a percentage of said first inverval, said timing means closing said relay during said first interval and opening it during said second interval whereby the furnace burner valve is cycled open and shut so that the heat exchanger cools during said second interval, said timing means further including means for synchronizing it to start timing at the beginning of said first interval in response to a call for heat from the household thermostat said controller further including a plenum thermostat mountable in the furnace plenum, wherein said timing means includes means responsive to the plenum thermostate to increase said second time interval by a predetermined amount in response to a plenum temperature in excess of a desired level.

2. The controller according to claim 1 whereby said percentage is a predetermined fraction of said first timing interval.

3. The controller according to claim 1 wherein said percentage is in the range of 20–80%.

4. A controller according to claim 1 wherein said percentage is 20%.

5. The controller according to claim 1 wherein said second time interval is long enough to permit the heat exchanger to cool substantially but short enough to maintain a temperature sufficient to maintain the furnace fan in a running condition.

6. A method for controlling a forced air furnace comprising the steps of:

(a) monitoring the thermostat to determined when the thermostat is calling for heat;

(b) timing a first interval starting when the thermostat calls for heat, said first interval approximately equal to the time delay between thermostat calling for heat and the fan starting when the furnace is first started from a cool state;

(c) igniting the burner at the beginning of said first interval;

(d) extinguishing the burner at the end of said first interval to allow the heat exchanger to cool;

(e) timing a second interval starting when said first interval ends, said second interval having a duration which is a percentage of said first interval, said heat exchanger being allowed to cool during said second interval;

(f) reigniting the burner at the end of said second interval; and (g) timing another first interval beginning at the end of said second interval;

(h) repeating steps (c)–(f) until the thermostat no longer calls for heat.

7. The method of claim 6 wherein said percentage is a fraction of said first interval.

8. The method according to claim 6 wherein said percentage is 20%.

9. The method of claim 6 wherein said second interval is of a duration sufficient to permit said heat exchanger to cool substantially but short enough to maintain said fan in a running condition.

10. In forced air heating system including a furnace controlled by a thermostat, the furnace including a burner, burner valve, heat exchanger, plenum and fan, a controller comprising:

relay means connectable between the furnace thermostat and the furnace burner valve; and timing means for controlling the furnace burner by opening and closing said relay, said timing means including:

means for maintaining said relay in a closed position from the time the household thermostat calls for heat until approximately when the furnace fan starts, said time comprising a first time interval established by timing the delay between a call for heat by the thermostat and the start of the fan when the furnace is started from a cool state, whereby the furnace burner is activated during said first time interval;

exchanger cooling means for opening said relay for a second time interval to extinguish the furnace burner and to cause the furnace heat exchanger to cool substantially as heat is extracted by the forced air circulation through the plenum;

means active after said second time interval for maintaining said relay in a closed position for a third time interval to cause the furnace burner to reignite and reheat the furnace heat exchanger; and said second and third time intervals timed to cause the furnace heat exchanger to vary substantially in temperature between relatively cool and relatively hot conditions said controller further including a furnace plenum temperature sensor and menas increasing the second time interval duration when said temperature exceeds a predetermined limit.

11. The controller according to claim 10 wherein said second time interval is approximately 10–80% the duration of said first interval.

12. The controller according to claim 10 wherein said second time interval is 20% the duration of said first interval.

* * * * *

UNITED STATES PATENT AND TRADEMARK OFFICE

CERTIFICATE OF CORRECTION

PATENT NO. : 4,667,874

DATED : May 26, 1987

INVENTOR(S) : Harold Johnson

It is certified that error appears in the above-identified patent and that said Letters Patent is hereby corrected as shown below:

Column 5, line 53, "Thus" should be --This--.

Column 6, line 52, insert --predetermined-- after "a".

Column 8, line 34 "menas" should be --means--.

Signed and Sealed this

Twenty-second Day of September, 1987

*Attest:*

DONALD J. QUIGG

*Attesting Officer* *Commissioner of Patents and Trademarks*